US006811446B1

(12) United States Patent
Chang

(10) Patent No.: US 6,811,446 B1
(45) Date of Patent: Nov. 2, 2004

(54) COMBINATION CONNECTOR SHELL

(75) Inventor: Chih-Kai Chang, Taoyuan Hsien (TW)

(73) Assignee: Speed THCH Corp., Taoyuan Hsien (TW)

( * ) Notice: Subject to any disclaimer, the term of this patent is extended or adjusted under 35 U.S.C. 154(b) by 0 days.

(21) Appl. No.: 10/680,259

(22) Filed: Oct. 8, 2003

(51) Int. Cl.[7] ..... H01R 4/26
(52) U.S. Cl. ..... 439/676; 439/76.1
(58) Field of Search ..... 439/76.1, 676, 439/701, 35.2, 353, 357, 358

(56) References Cited

U.S. PATENT DOCUMENTS 5,041,022 A * 8/1991 Sekiguchi ..... 439/609
2001/0018288 A1 * 8/2001 Nicholls ..... 439/402
2001/0021608 A1 * 9/2001 Borbolla et al. ..... 439/676
2003/0157842 A1 * 8/2003 Arnett et al. ..... 439/676

* cited by examiner

*Primary Examiner*—P. Austin Bradley
*Assistant Examiner*—James R. Harvey
(74) *Attorney, Agent, or Firm*—Birch, Stewart, Kolasch & Birch, LLP

(57) ABSTRACT

A combination connector shell is constructed to include an electrically insulative front housing adapted to hold first terminals, the front housing having two springy hooks and LED insertion slot, an open frame type rear housing, the rear housing having two front hooks detachably hooked up with the springy hooks of the front housing and two bottom hooks, and a terminal holder adapted to hold a circuit board in the rear housing and a set of second terminals, the terminal holder having two hook holes respectively engaged with the bottom hooks of the rear housing.

9 Claims, 13 Drawing Sheets

COMBINATION CONNECTOR SHELL

BACKGROUND OF THE INVENTION

1. Field of the Invention

The present invention relates to an electric connector and, more specifically, to a combination connector shell for electric connector, which is comprised of a front housing, a rear housing, and a terminal holder that are connected to one another by hook joints and prohibited from horizontal and vertical displacement relative to one another.

2. Description of the Related Art

Following fast development of computer technology, various versatile electric connectors are developed for signal transmission in computer networks. For example, an electric connector may be provided with a LED indicator circuit to indicate different signal transmission status or failure of the circuit. Regular RJ45 connectors are commonly used for digital communication. These connectors generate high frequency electric waves that interfere with surrounding electric apparatus. Further, the internal transmission signal tends to be interfered noises produced in the external cable. In order to eliminate EMI (electromagnetic interference), a metal shield or filter module may be used. When a filter module is used, the filter module must be installed within the circuit board and the terminal holder in the electrically insulative housing. After installation, the positive connection between the housing and the terminal holder and the electric connection among the terminals, the filter module and the circuit board must be well checked, assuring accurate signal transmission.

FIGS. 10 and 11 show an electric connector according to the prior art. According to this design, the electric connector comprises a first terminal holder B holding a set of first terminals B1, a second terminal holder D holding a set of second terminals D1, an electrically insulative housing A adapted to accommodate the terminal holders B and D, the insulative housing A having two backward hook arms A1, a circuit board C to which the first terminals B1 and the second terminals D1 are soldered, the circuit board C having two side notches C1 and C2 respectively forced into engagement with the hook arms A1, and a metal shield E covering the housing A. This structure of electric connector has drawbacks. When soldering the terminals B1 and D1 to the circuit board C, the terminal holders B and D interfere with the soldering operation. Further, simply using the hook arms A1 to hold the circuit board C cannot prohibit vertical displacement of the circuit board C relative to the insulative housing A.

FIGS. 12 and 13 show another structure of electric connector according to the prior art. This structure of electric connector is comprised of an outer housing, an inner housing, and a terminal holder. The main advantage of this structure of electric connector is its detachable structural design, i.e. either of the outer housing, the inner housing and the terminal holder is replaceable when damaged. According to this design, the connection of the terminal holder with the terminals and the circuit board is complicated. The terminal holder is inserted into the inner housing and then the outer housing after installation of the circuit board in the terminal holder. The hook joint between the terminal holder and the inner housing cannot prohibit vertical displacement of the terminal holder relative to the inner housing and the outer housing. Further, it is difficult to solder terminals to the circuit board within a limited space.

Therefore, it is desirable to provide a combination connector shell for electric connector that eliminates the aforesaid drawbacks.

SUMMARY OF THE INVENTION

The present invention has been accomplished under the circumstances in view. According to one aspect of the present invention, the combination connector shell comprises an electrically insulative front housing adapted to hold first terminals, an electrically insulative rear housing abutted against the rear coupling side of the front housing, a terminal holder attached to the bottom side of the rear housing and adapted to hold second terminals, a second coupling structure adapted to lock the rear housing to the front housing, and a first coupling structure adapted to lock the terminal holder to the rear housing. According to another aspect of the present invention, the terminal holder has a top receiving space adapted to accommodate a circuit board, for enabling a filter module and other electronic component parts as well as the first and second terminals to be conveniently soldered to the circuit board. According to still another aspect of the present invention, the terminal holder further comprises two stop rods bilaterally extended from the front side for insertion into insertion slots in the front housing to prevent horizontal displacement of the terminal holder relative to the front housing.

DETAILED DESCRIPTION OF THE PREFERRED EMBODIMENT

Figure 1:
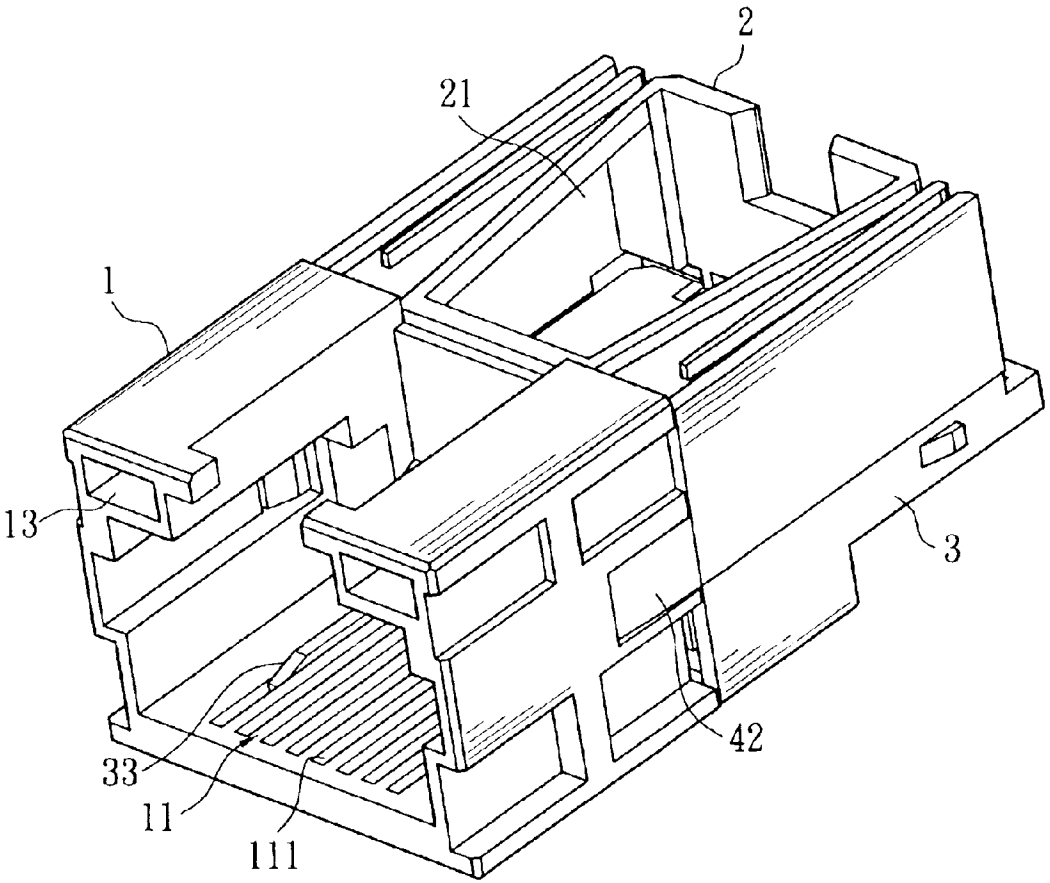
FIG. 1 is an elevational view of a combination connector shell according to the present invention.
Figure 2:
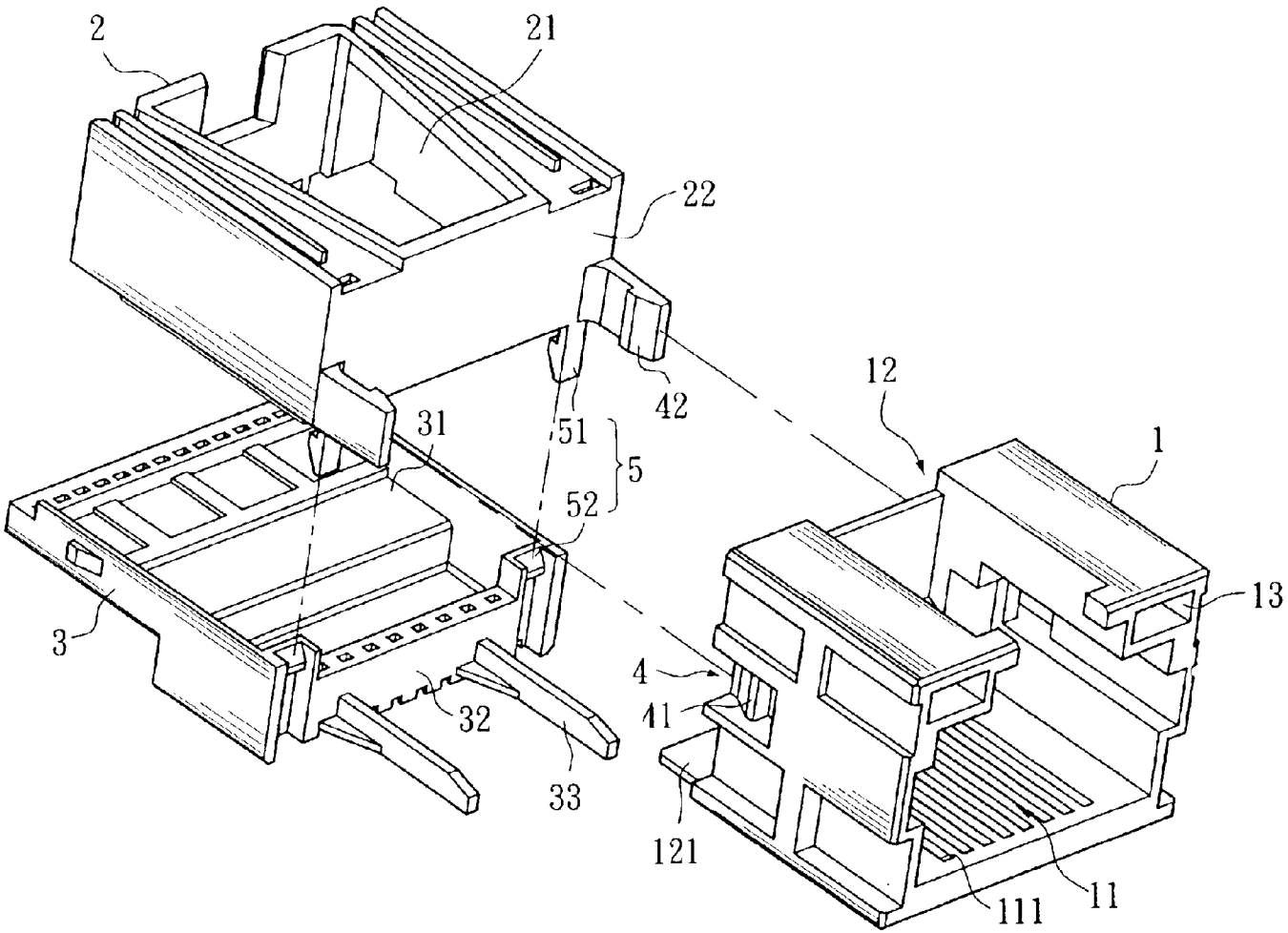
FIG. 2 is an exploded view of the combination connector shell according to the present invention.
Figure 3:
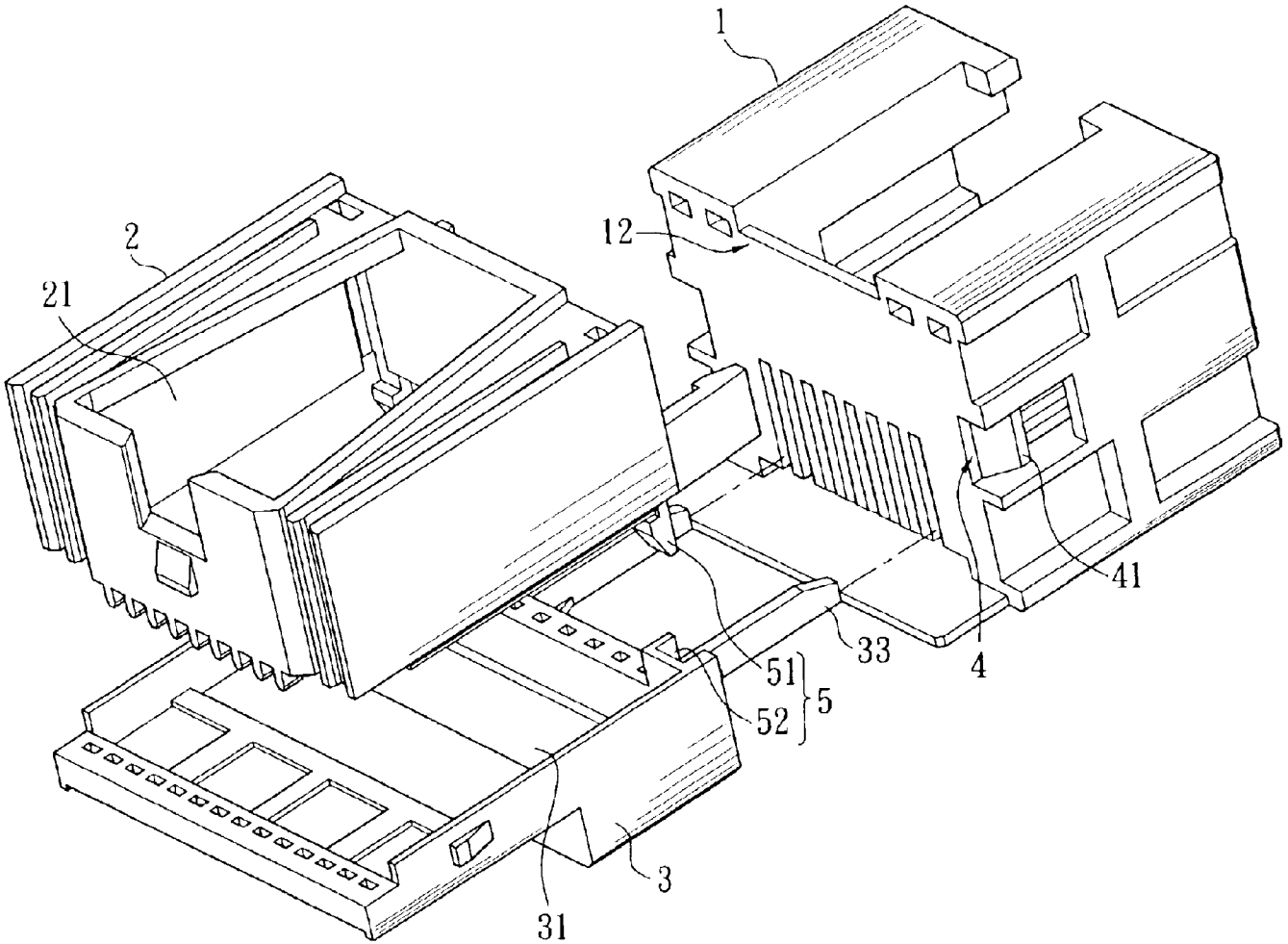
FIG. 3 is another exploded view of the combination connector shell according to the present invention when viewed from another angle.
Figure 4:
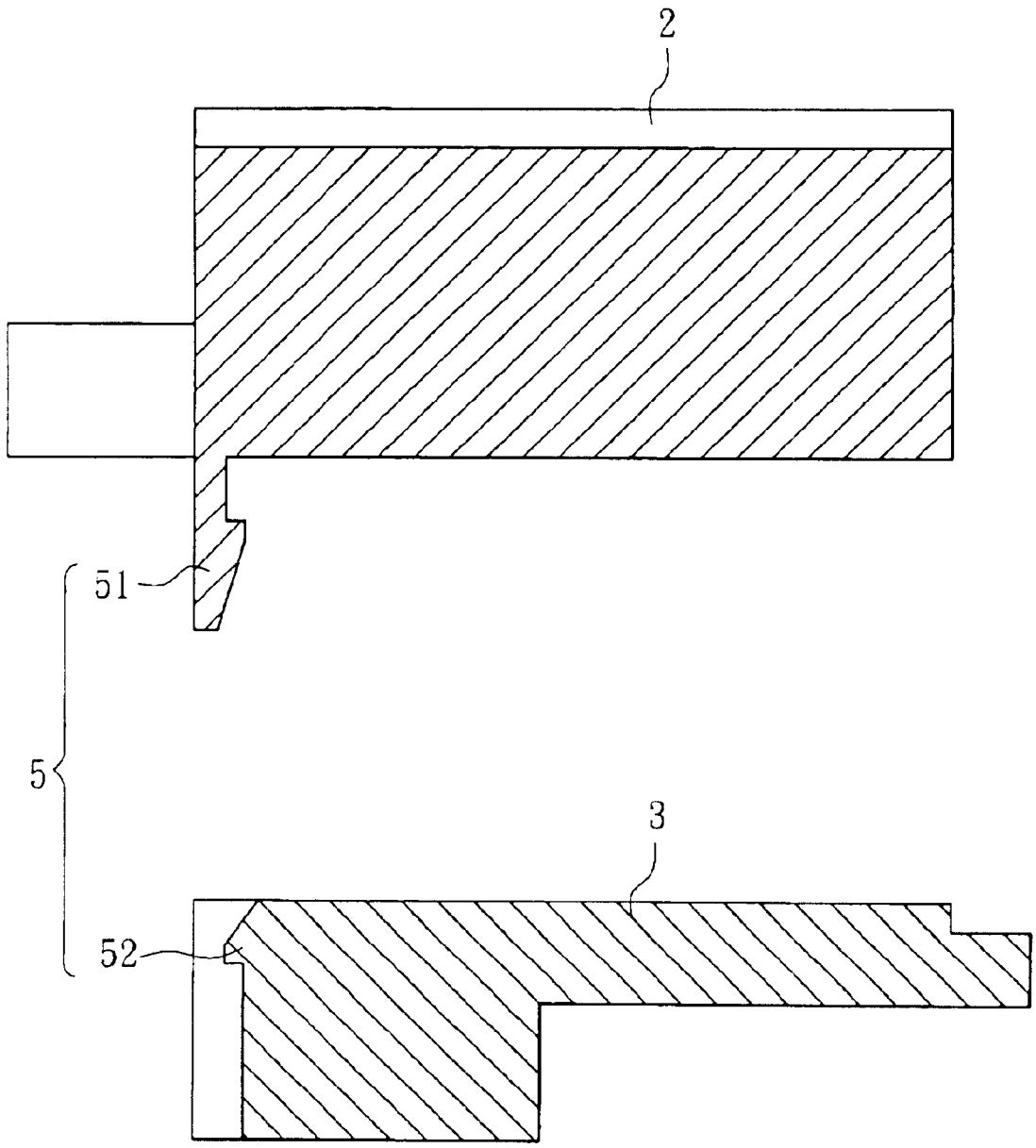
FIG. 4 is a schematic sectional view showing the coupling structure between the rear housing and the terminal holder according to the present invention.
Figure 5:
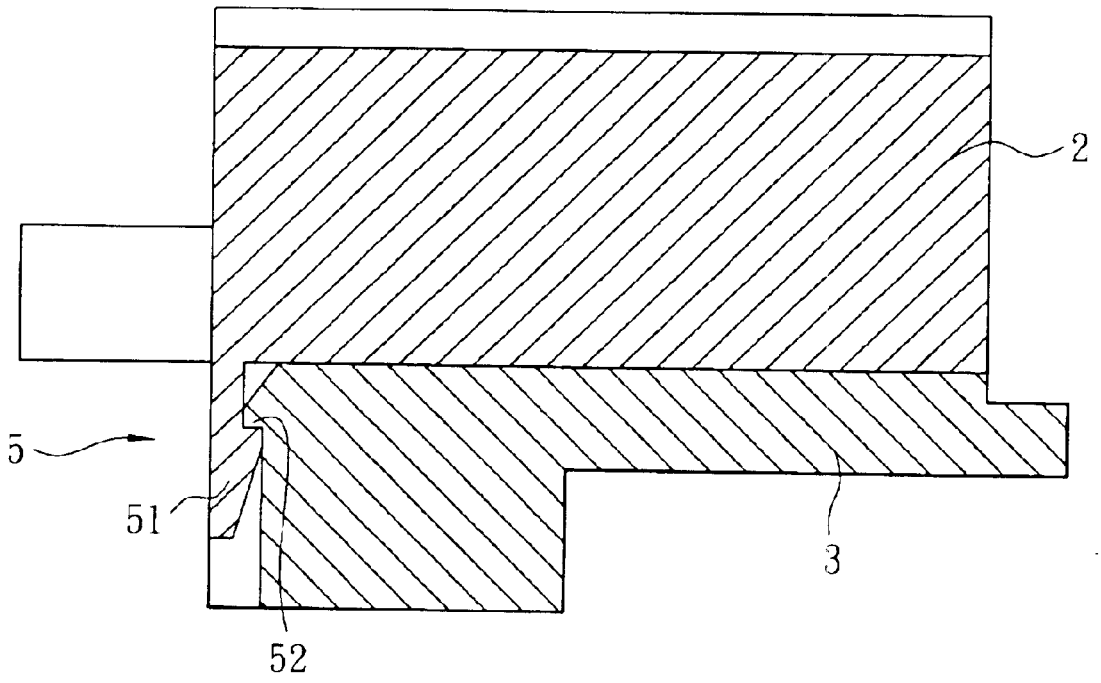
FIG. 5 is a sectional assembly view of FIG. 4.
Figure 6:
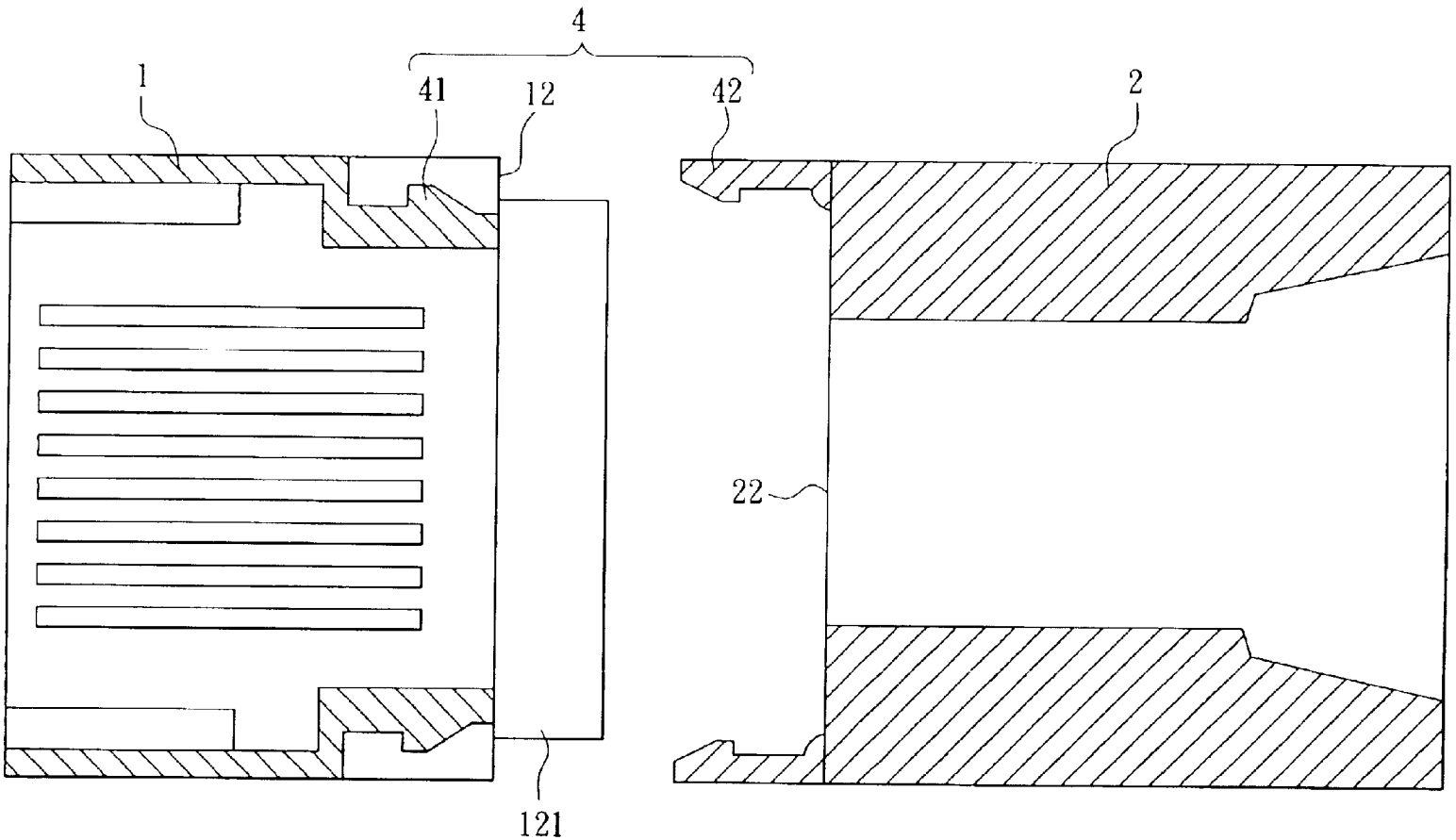
FIG. 6 is a schematic sectional view showing the coupling structure between the front housing and the rear housing according to the present invention.
Figure 7:
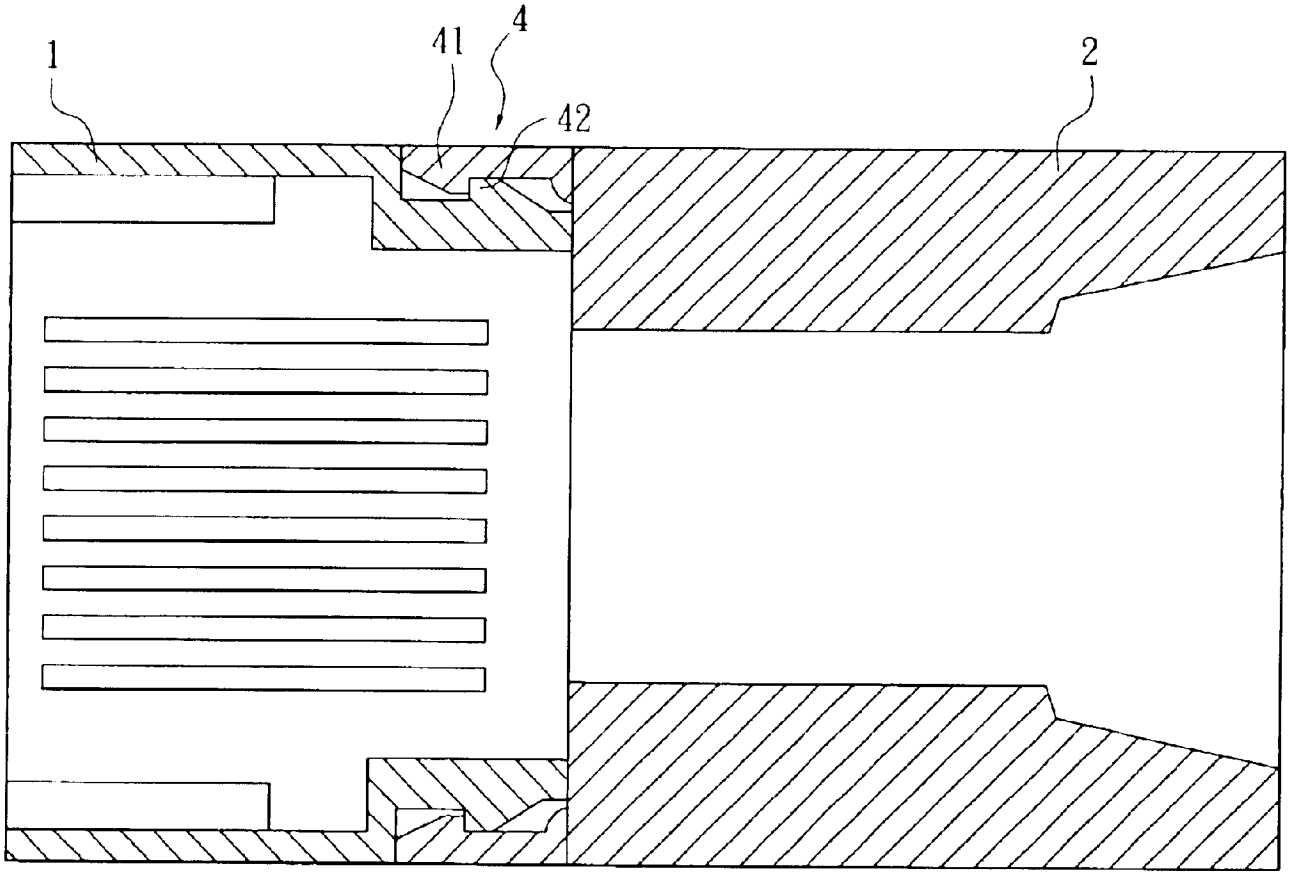
FIG. 7 is a sectional assembly view of FIG. 6.

Referring to FIGS. 1~3, a combination connector shell in accordance with the present invention is shown comprised of an electrically insulative front housing 1, an electrically insulative rear housing 2, and a terminal holder 3.

The front housing 1 comprises a front receiving chamber 11, a rear coupling side 12, two front insertion holes 13 bilaterally horizontally extended through the rear coupling side 12 at the top of the front receiving chamber 11, insertion slots 111 cut through the bottom wall of the front receiving chamber 11 and a part of the rear coupling side 12, a rack 121 backwardly protruded from the rear coupling side 12 near the bottom, and two springy hooks 41.

The rear housing 2 is shaped like a hollow rectangular frame defining a center opening 21, having two front hooks 42 bilaterally forwardly extended from the front coupling side 22 and two bottom hooks 51 bilaterally downwardly extended from the bottom wall. The front hooks 42 and the springy hooks 41 form a coupling structure 4.

The terminal holder 3 comprises a top receiving space 31, a plurality of terminal slots disposed at the bottom side of the top receiving space 31, two stop rods 33 bilaterally forwardly extended from the front coupling side 32 at the bottom, and two vertical hook holes 52 disposed at two sides of the front coupling side 32 corresponding to the bottom hooks 51. The bottom hooks 51 and the hook holes 52 form a coupling structure 5.

The assembly process of the combination connector shell is outlined hereinafter with reference to FIGS. 4~7. The terminal holder 3 is secured to the bottom side of the rear housing 2 by forcing the hook holes 52 into engagement with the bottom hooks 51. After connection of the terminal holder 3 to the rear housing 2, the front coupling side 22 of the rear housing 2 is attached to the rear coupling side 12 of the front housing 1 to force the front hooks 42 into engagement with the springy hooks 41 and to insert the stop rods 33 into the insertion slots 111, for enabling the terminal holder 3 to be supported on the rack 121.

Figure 8:
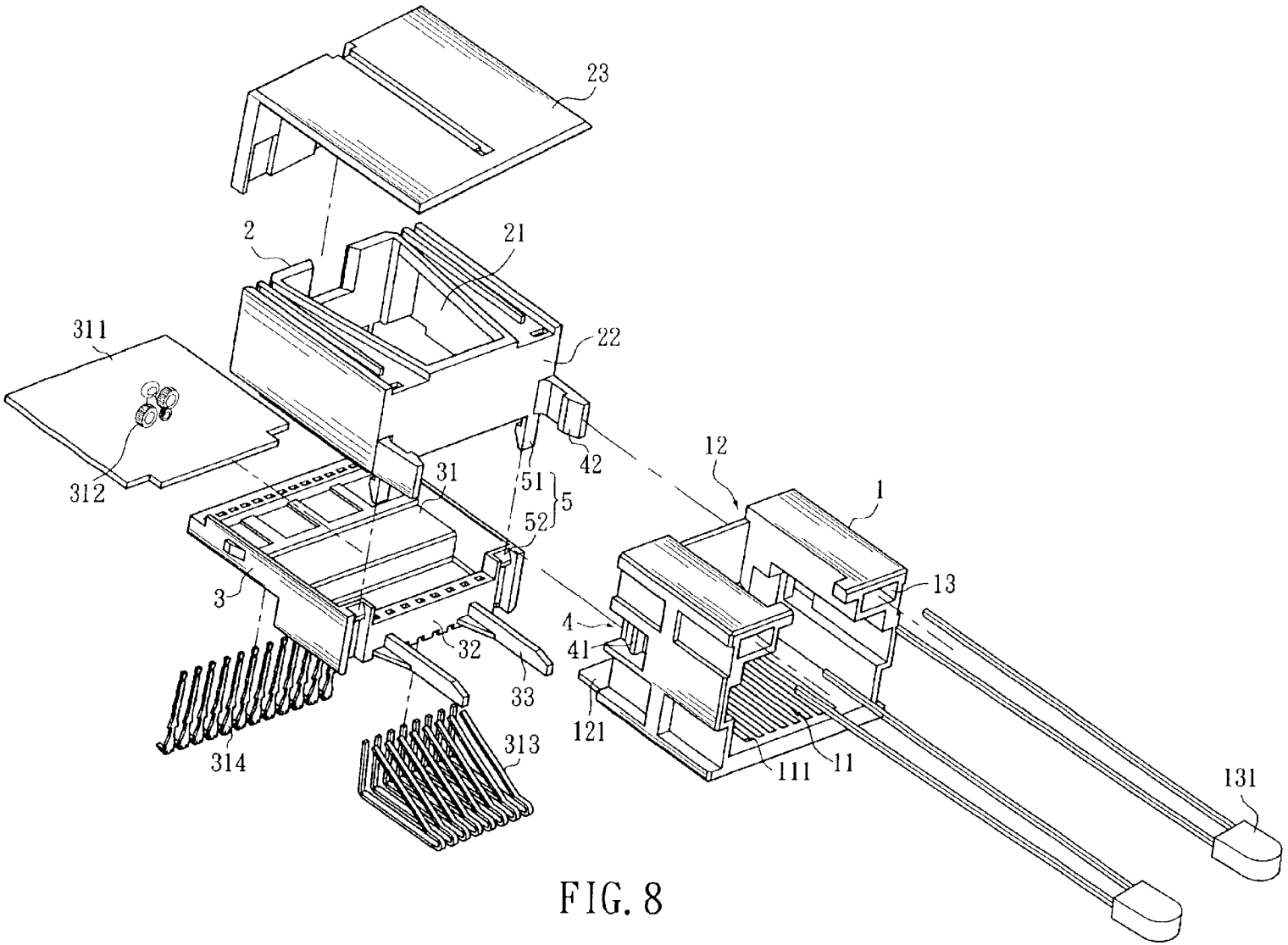
FIG. 8 is an exploded view of an electric connector constructed according to the present invention.
Figure 9:
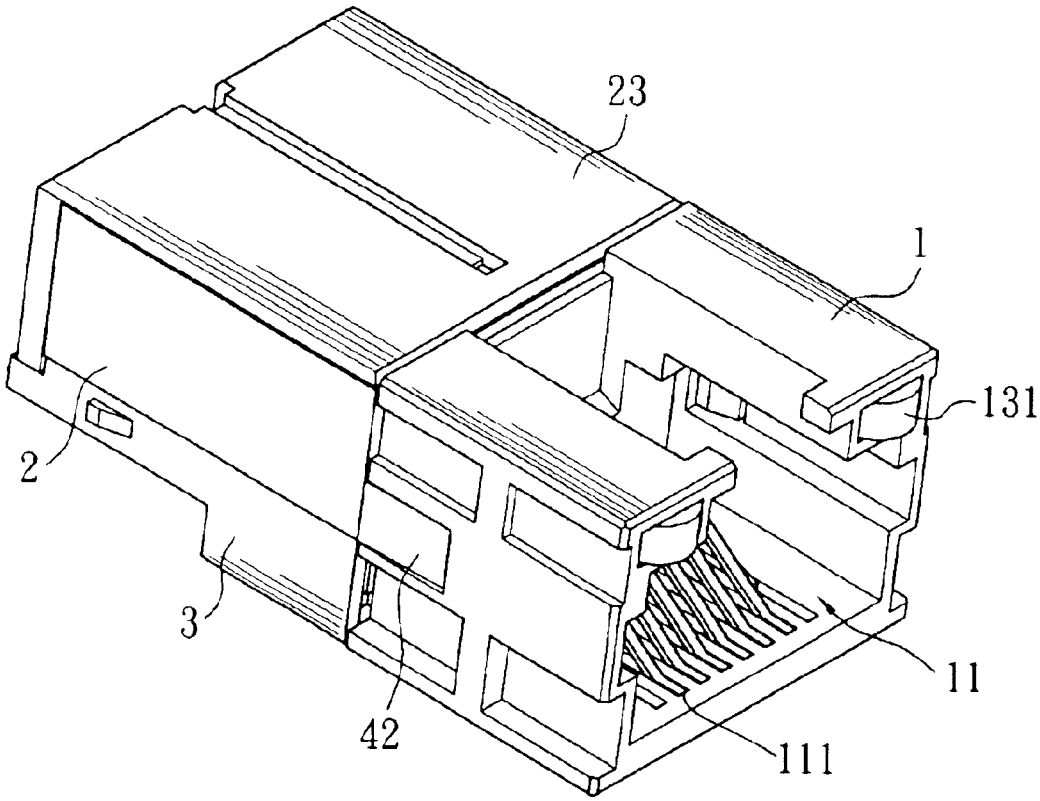
FIG. 9 is an elevational assembly view of the electric connector shown in FIG. 8.
Figure 10:
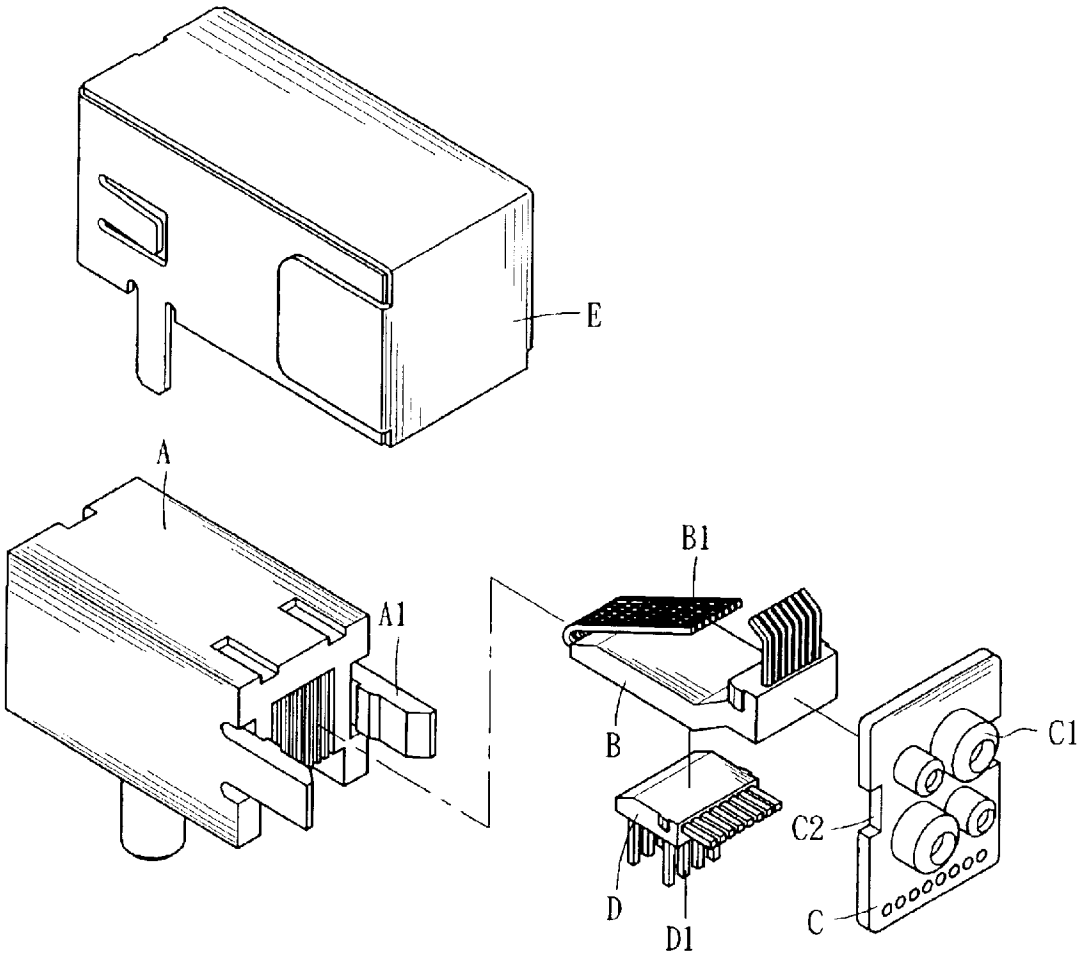
(PRIOR ART) FIG. 10
FIG. 10 is an exploded view of an electric connector according to the prior art.
Figure 11:
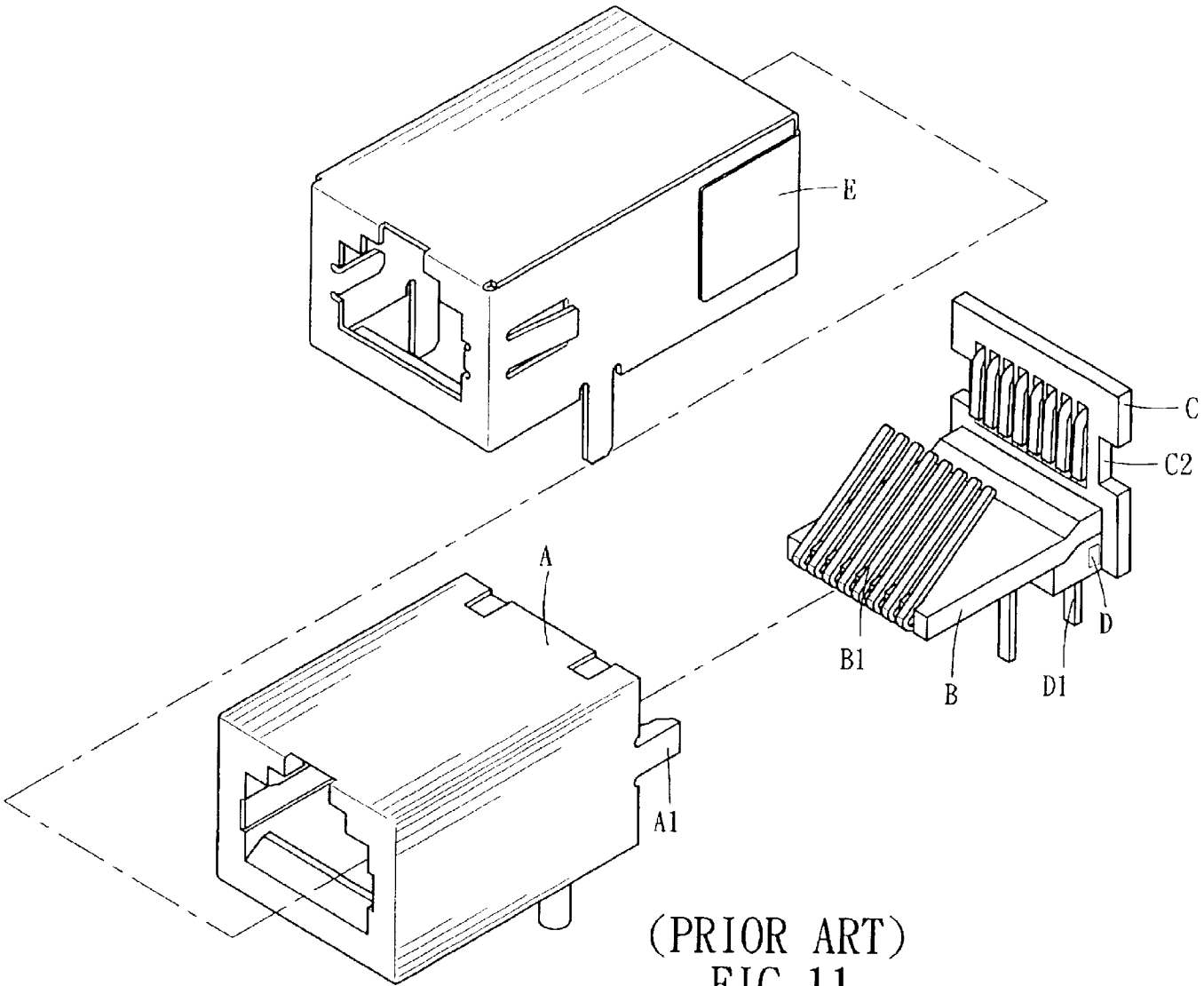
(PRIOR ART) FIG. 11
FIG. 11 is an exploded view in an enlarged scale of a part of the electric connector shown in FIG. 10.
Figure 12:
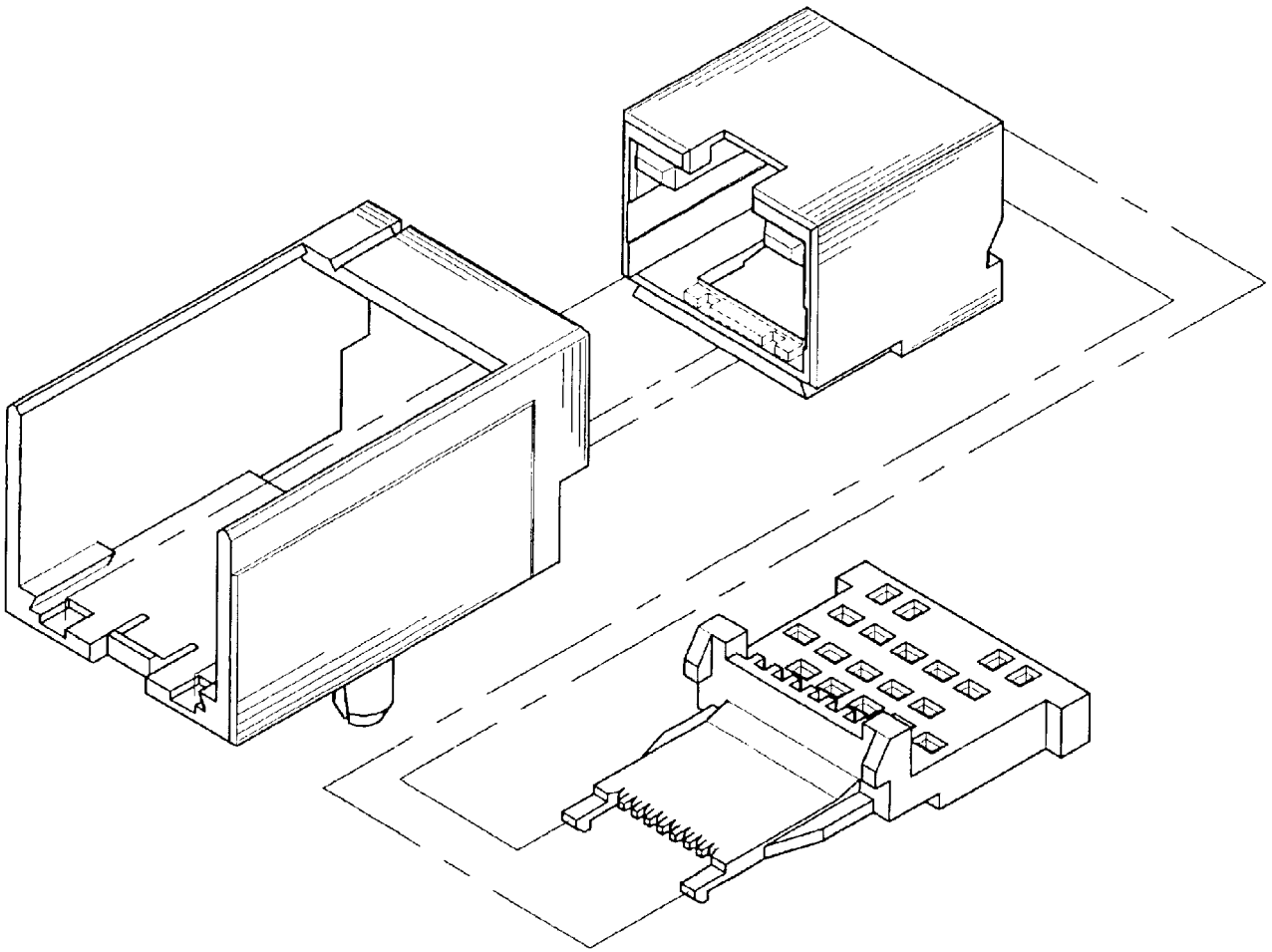
(PRIOR ART) FIG. 12
FIG. 12 is an exploded view of another structure of electric connector according to the prior art.
Figure 13:
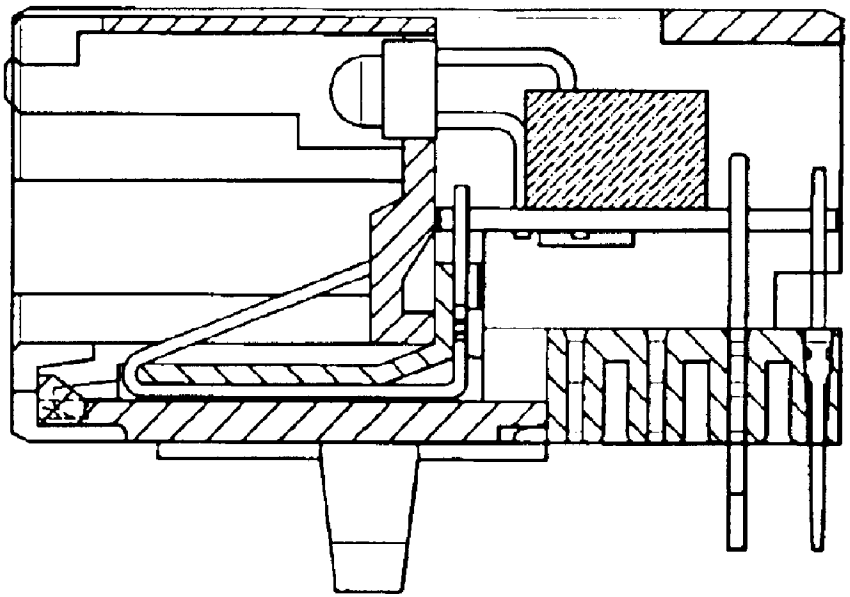
(PRIOR ART) FIG. 13
FIG. 13 is a sectional assembly view of the electric connector shown in FIG. 12.

Referring to FIGS. 8 and 9, the top receiving space 31 of the terminal holder 3 is adapted to accommodate a circuit board 311, a filter module 312, and other electronic components. Because the top receiving space 31 is an open space without barriers around the border area, first terminals 313 and second terminals 314 can conveniently be soldered to the circuit board 311. The first terminals 313 are respectively mounted in the insertion slots 111 inside the front housing 1. The front insertion holes 13 of the front housing 1 are adapted to accommodate a respective LED (light emitting diode) 131. The circuit board 311 is mounted in the top receiving space 31 inside the terminal holder 3 before connection of the terminal holder 3 to the rear housing 2. After connection of the terminal holder 3 to the rear housing 2, the circuit board 311 is disposed within the center opening 21 of the rear housing 2. Thereafter, a top cover 23 is covered on the rear housing 2 to block the center opening 21.

A prototype of combination connector shell has been constructed with the features of FIGS. 1~9. The combination connector shell functions smoothly to provide all of the features discussed earlier.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A combination connector shell comprising:

an electrically insulative front housing, said front housing comprising a front receiving chamber, a rear coupling side, insertion slots cut through a bottom wall of said front receiving chamber and a part of said rear coupling side;

a rear housing shaped like a hollow rectangular frame defining a center opening, said rear housing having a front coupling side abutted against the rear coupling side of said front housing and a bottom side;

a terminal holder disposed at the bottom side of said rear housing, said terminal holder having a front coupling side abutted against the rear coupling side of said front housing below said rear housing, and a top receiving space facing the center opening of said rear housing and adapted to accommodate a circuit board; and a first coupling structure, said first coupling structure comprising a plurality of first fastening members and second fastening members respectively disposed at said rear housing and said terminal holder and adapted to lock said terminal holder to the bottom side of said rear housing.

2. The combination connector shell as claimed in claim 1, further comprising a second coupling structure, said second coupling structure comprising a plurality of first fastening members and second fastening members respectively disposed at said front housing and said rear housing and adapted to lock the front coupling side of said rear housing to the front coupling side of said front housing.

3. The combination connector shell as claimed in claim 2, wherein the first fastening members of said second coupling structure are springy hooks disposed at two sides of the rear coupling side of said front housing.

4. The combination connector shell as claimed in claim 2, wherein the second fastening members of said second coupling structure are front hooks bilaterally forwardly extended from the front coupling side of said rear housing and respectively hooked up with the first fastening members of said second coupling structure at said front housing.

5. The combination connector shell as claimed in claim 1, wherein said front housing further comprises a rack extended from the rear coupling side near the bottom and adapted to support said terminal holder.

6. The combination connector shell as claimed in claim 1, wherein said front housing further comprising at least one front insertion hole extended from a front side thereof through said rear coupling side and adapted to accommodate a respective light emitting device.

7. The combination connector shell as claimed in claim 1, wherein the first fastening members of said first coupling structure are bottom hooks bilaterally extended from a bottom side of said rear housing and adapted to engage the second fastening members of said first coupling structure at said terminal holder.

8. The combination connector shell as claimed in claim 7, wherein the second fastening members of said first coupling structure are hook holes disposed at two sides of the front coupling side of said terminal holder and adapted to receive the bottom hooks of the first fastening members of said first coupling structure at said rear housing.

9. The combination connector shell as claimed in claim 1, wherein said terminal holder further comprises a plurality of stop rods forwardly extended from the front coupling side for insertion into the insertion slots of said front housing.

* * * * *